US005943757A

United States Patent [19]

Magley

[11] Patent Number: 5,943,757

[45] Date of Patent: Aug. 31, 1999

[54] ONE-STEP INSERTION DIE FOR A THREADED FITTING

[75] Inventor: Robert E. Magley, Waterloo, Ind.

[73] Assignee: Rieke Corporation, Auburn, Ind.

[21] Appl. No.: 08/994,158

[22] Filed: Dec. 19, 1997

[51] Int. Cl.[6] ..... B21D 39/00

[52] U.S. Cl. ..... 29/509; 29/516; 29/33.52; 29/34 R; 29/243.5

[58] Field of Search ..... 29/505, 509, 515, 29/33.52, 34 R, 565, 566.1, 773, 243.517, 243.58, 283.5, 516, 243.5

[56] References Cited

U.S. PATENT DOCUMENTS

| | | | |
|---|---|---|---|
| 3,571,891 | 3/1971 | Roberts | 29/512 |
| 3,683,482 | 8/1972 | Gluchowski | 29/773 |
| 5,075,951 | 12/1991 | Schurr et al. | 29/453 |

*Primary Examiner*—David P. Bryant

*Attorney, Agent, or Firm*—Woodard, Emhardt, Naughton Moriarty & McNett Patent and Trademark Attorneys

[57] ABSTRACT

An insertion die for the installation of an internally-threaded flange into a drum head by means of a single stroke cycle of a cooperating press includes components arranged for piercing a hole in the drum head and crimping a raised embossment which is formed in the drum head over and around the flange for securely anchoring the flange into the drum head embossment. The insertion die is configured with two workstations, one for a two inch inside diameter flange and the other for a ¾ inch inside diameter vent closure. The insertion die includes a moveable die center at each workstation which is initially positioned in a blocking configuration to prevent crimping jaws from closing. The die center is moveable to a lower position below the crimping jaws which allows the jaws to act on the drum head embossment for crimping the embossment onto the flange. The die center is moveable from a blocking position to a release position based upon the state of a release mechanism which includes a three pin configuration and the shifting of the middle pin which allows the die center to drop down below the crimping jaws.

21 Claims, 11 Drawing Sheets

ONE-STEP INSERTION DIE FOR A THREADED FITTING

BACKGROUND OF THE INVENTION

The present invention relates in general to metal drum fabrication and the configuring of the drum end with an internally-threaded fitting (or flange) for receipt of a threaded closure or plug. More specifically the present invention relates to a one-step insertion die for installing the internally-threaded fitting (or flange) and crimping it in place, thereby replacing and simplifying the present two-step insertion die and insertion method. By being able to complete the entire task in one press stroke cycle, the required machinery is simplified and the through put is increased.

Large metal drums for the storage and transport of fluid substances have been used for many years. At least as far back as the 1940's, one end or head of these metal drums was configured with a pierced hole surrounded by a formed pocket or raised embossment. An internally-threaded metal flange with peripheral edge contouring was then placed into the formed and raised embossment and then crimped in place. The crimping operation formed the metal of the embossment into and around the peripheral edge contouring as well as beneath a radial lip of the flange. Once the flange was anchored in place in this manner in a generally liquid-tight fashion, the internal threads of the flange were available for receipt of an externally-threaded closure or plug.

The insertion dies and method which were used involved two separate press operations on the drum head in order to insert the flange. The first operation involved piercing the hole in the drum head and creating a raised pocket (i.e., the formed embossment). The second operation used a die to crimp or clinch the flange into the previously formed embossment on the drum head. In effect, crimping jaws were used which pushed the material of the embossment into and around the peripheral edge of the flange so as to position portions of the metal embossment not only on the upper surface of the flange, but around the peripheral edge and actually beneath that edge so as to securely anchor and lock the flange in position.

This earlier method required the use of two separate presses and two separate dies. This created a certain inefficiency which could be improved upon if a way could be found to prepare the drum head and securely insert the flange using one press and one die with a single press stroke cycle. The present invention provides such an improvement in a novel and unobvious manner. According to the present invention a single press and single die are used to both pierce the hole and create the embossment in the drum head and subsequently to crimp the metal of the embossment around and over the flange so as to anchor the flange into the raised embossment. This is all achieved in one stroke cycle of the press. The insertion die improvement provided by the present invention is able to be accomplished by allowing some of the embossment forming tooling to drop out of the way after the embossment is made and using another component of the embossment forming tooling to also function as the crimping tool.

SUMMARY OF THE INVENTION

An insertion die for the installation of an internally-threaded flange into a drum head by means of a single stroke cycle of a cooperating press according to one embodiment of the present invention comprises a pierce punch and cooperating piercing hole die for creating a hole in the drum head, an anvil for receipt of the flange, crimping jaws for crimping the drum head onto the flange, a moveable die center positioned in part between the flange and the drum head and being constructed and arranged to prevent the crimping of the drum head onto the flange when in a first position and a release mechanism operably coupled to the moveable die center for creating a clearance space, the creation of the clearance space enabling the moveable die center to move to a second position where the die center is no longer between the flange and the drum head, thereby permitting the crimping jaws to crimp the drum head onto the flange during the single stroke cycle of the press.

One object of the present invention is to provide an improved insertion die for the installation of an internally-threaded flange into a drum head.

Related objects and advantages of the present invention will be apparent from the following description.

DESCRIPTION OF THE PREFERRED EMBODIMENT

Figure 1:
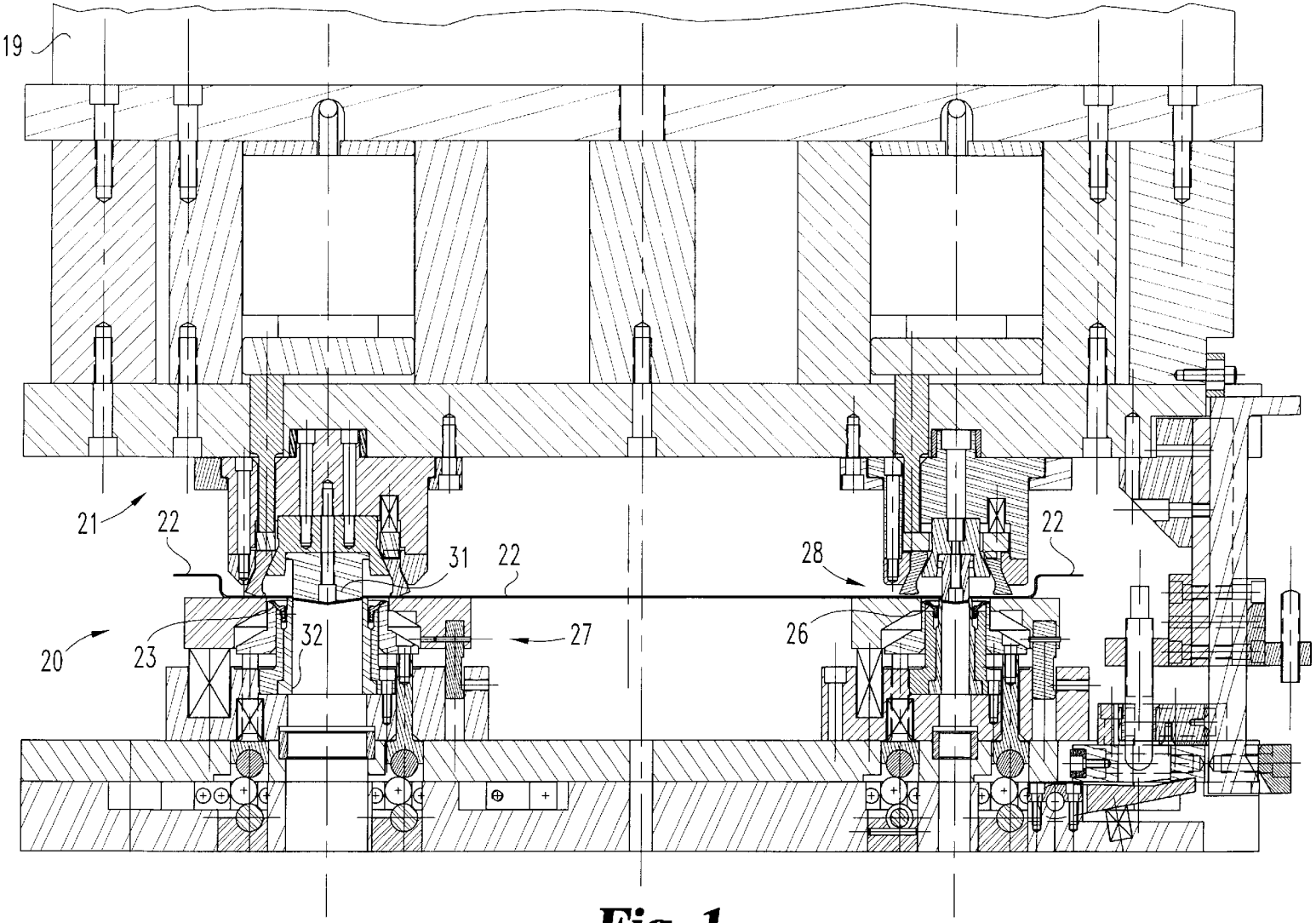
FIG. 1 is a diagrammatic, front elevational view in full section of an insertion die with a cooperating press according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1A:
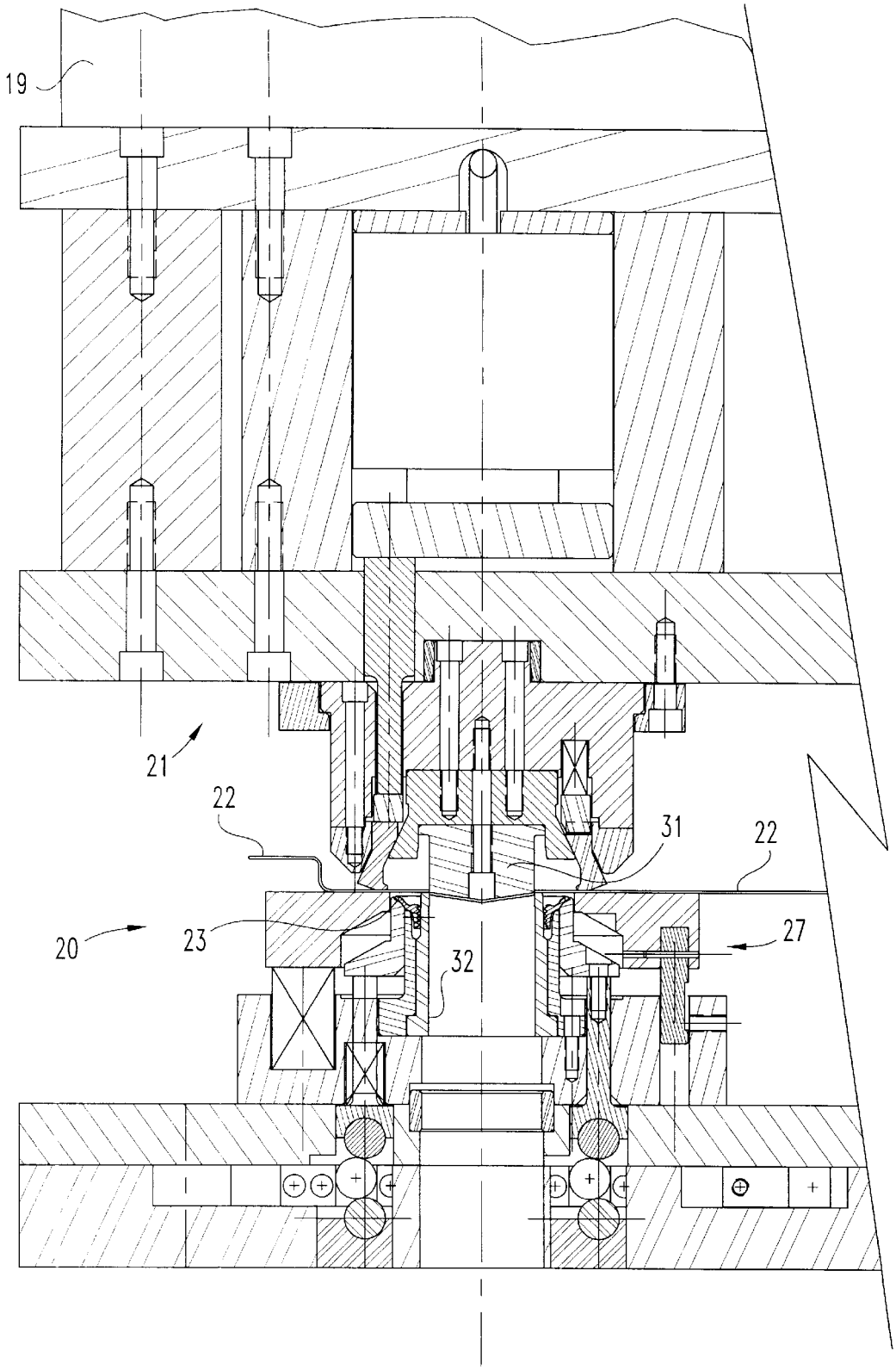
FIG. 1A is an enlarged detail of one workstation of the FIG. 1 insertion die.

Referring to FIGS. 1 and 1A, there is illustrated a one-step insertion die 20 and a cooperating one-stroke hydraulic pressure unit 21 which are used in cooperation with a press 19 to first prepare a metal drum head 22 for receipt of an internally-threaded metal flange 23 and then to crimp the drum head 22 material around the flange 23. The forming of the drum head metal relative to the flange is such that it extends over a portion of the top surface of the flange, around the periphery of the flange, and actually underneath the outer peripheral edge of the flange so as to securely anchor the flange and drum head together in a secure combination.

Figure 3:
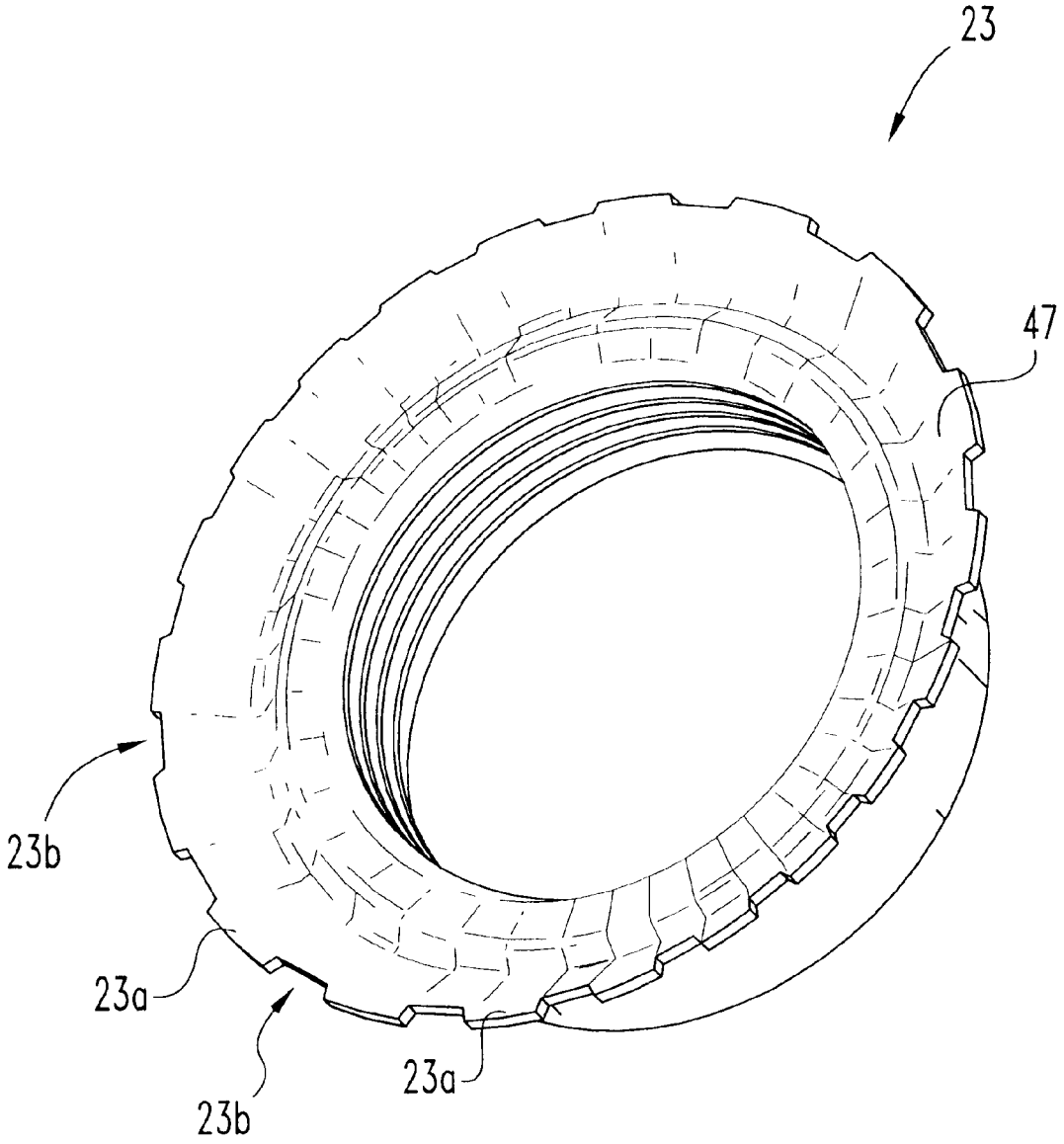
FIG. 3 is a perspective view of an internally-threaded flange which is to be installed in a drum head according to a typical embodiment of the present invention.

The flange 23 (see FIG. 3) is constructed and arranged with peripheral edge contouring with serrations 23*a* and recesses 23*b* in alternating sequence in order to facilitate the subsequent crimping operation. Included as part of the insertion die 20 and pressure unit 21 combination is a spaced-apart second workstation where a vent opening is created. The press 19 includes various stationary portions and various moveable components (not specifically illustrated), such as a press ram, which act against portions of the pressure unit 21 which in turn act against portions of the insertion die 20 for the required cooperative movements and actions as described herein.

Preparation of the drum head 22 begins with a hole piercing operation at both workstations which includes fabrication of a raised pocket referred to as the embossment. As still part of the same press stroke cycle, the metal of the formed or raised embossment is crimped into and around the flange 23 and beneath a radial lip of the flange. The ability to achieve in one step and one press stroke what previously required two dies and two press operations is the result of allowing some of the embossment forming tooling to drop out of the way after the embossment is made and by using another component of the embossment forming tooling to also function as the crimping tooling.

With continued reference to FIGS. 1 and 1A, the mechanical and structural details of the insertion die 20 and pressure unit 21 and their cooperating operation will now be described. It should first be noted that a typical drum head includes both a two inch inside diameter flange or fitting (at the first workstation) and in spaced relation thereto a ¾ inch inside diameter flange or fitting (at the second workstation). Since the press 19 can process both flanges simultaneously, both insertion stations are combined in a single setup for a single drum head. Likewise, a single press is utilized for both insertion die workstations. Since the design of these two insertion stations are substantially the same, the detailed description which follows focuses primarily on the first workstation for the two inch inside diameter flange. A detailed illustration of the internally-threaded flange 23 is set forth in FIG. 3.

The first step in the process is to place a "set" of flanges 23 and 26 in the bottom of each insertion die portion, noting that insertion die 20 includes two spaced-apart workstations 27 and 28. The two inch inside diameter flange 23 is placed in the die portion at the first workstation 27 and the ¾ inch inside diameter flange 26 is placed in the die portion at the second workstation 28. Next, the drum head 22 is placed over the two flanges 23 and 26. With the components loaded in position (see FIGS. 1 and 1A), the first operational step is to pierce a corresponding hole in the drum head 22 for each flange.

With specific reference to the first workstation 27 and the two inch inside diameter flange 23, the hole piercing operation involves the use of the pierce punch 31 and cooperating die 32. The pierce punch 31 is driven into die 32 by means of a moveable ram portion (not illustrated) of press 19. As would be understood, other portions of the press remain stationary. It is also to be noted that FIG. 1A is an enlarged illustration of the first workstation which will be the focus of the remaining description.

Figure 2:
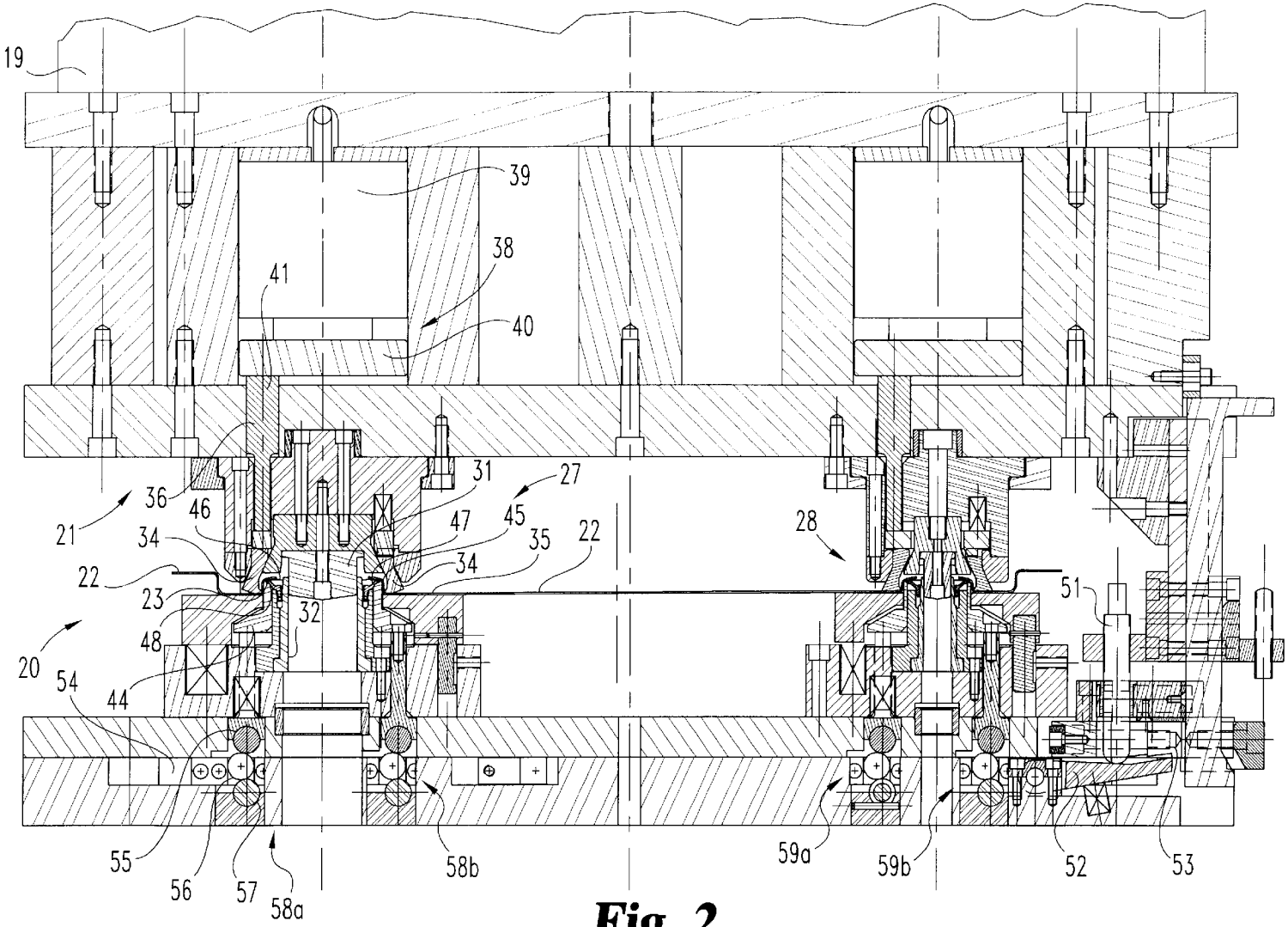
FIG. 2 is a diagrammatic front elevational view in full section of the FIG. 1 insertion die at a later time in the press stroke cycle.
Figure 2A:
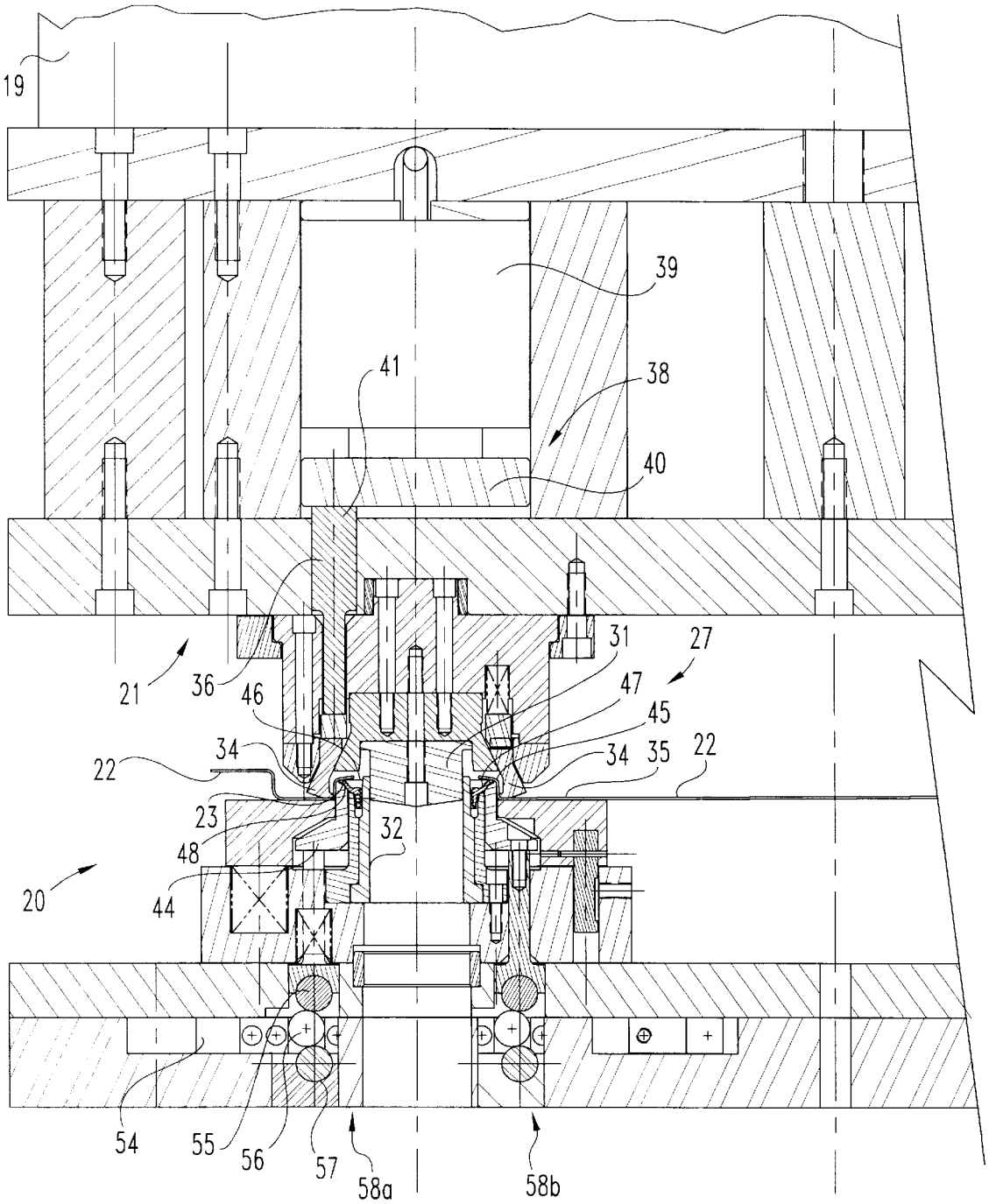
FIG. 2A is an enlarged detail of one workstation of the FIG. 2 insertion die.

Referring now to FIGS. 2 and 2A and their sequential relationship to FIGS. 1 and 1A, the next stage or processing step in the overall cycle is illustrated. As the ram portion of the press 19 continues with its stroke in a downward direction (i.e., a direction toward flange 23), the crimping jaws 34 contact the top 35 of the drum head 22 and push in a downward direction. At this later point in time in the operation sequence, the jaws 34, which ultimately become crimping jaws, are used in a pressing operation to effectively seat the material of the embossment against the top surface of the flange 23. At this point in the operation sequence, the crimping jaws 34 are unable to retract due to the support received by the upper riser block 36. The upper riser block 36 is supported by a mechanical system (part of pressure unit 21) using high pressure nitrogen springs 38. Nitrogen springs of the type used herein are essentially nitrogen charged pistons which act like high pressure springs. The housing 39 contains the pressurized nitrogen gas and the moveable piston 40 acts against the abutting end 41 of the upper riser block 36.

As the ram portion of the press 19 continues its downward movement during the same, single press stroke cycle, the crimping jaws 34 continue pushing down on the top surface 35 of drum head 22. This downward force and movement is opposed by the die center 44 which acts to help form the inside diameter surface of the embossment 45 which results from the cooperative motion of the ram portion relative to the insertion die. As embossment 45 is formed, the pierced hole 46 in the drum head 42 opens up (i.e., increases) in diameter. This is due to the manner in which the drum head metal is drawn in order to create the raised, annular embossment 45. Ultimately, the final diameter of the pierced hole will be larger than the major thread diameter of flange 23.

At this stage in the operation cycle, it would be expected to crimp the sidewall of the embossment underneath the outer radial lip 47 of the flange 23. However, the upper tip 48 of the die center 44 is still positioned between the embossment sidewall and the radial lip 47 of the flange and is radially in line with the jaws 34. This arrangement keeps and restricts the crimping jaws 34 from being able to move in an inward radial direction as is typical of the crimping step for flanges of the type disclosed herein (see FIG. 3).

At this point in the single stroke cycle of the press, the sear pin 51 hits the sear 52 and disengages slide block 53. The slide block 53 is attached to the cam rail 54. The spring-loaded configuration which cooperates with the slide block 53 pushes the cam rail 54 in a horizontal direction which in the various drawing illustrations is to the left. This in turn changes the alignment of the three stacked pins 55, 56, and 57, noting that there are in fact four sets of three stacked pins, two each at each of the two workstations. By changing the alignment of the three stacked pins and more specifically by shifting pin 56 horizontally to the left, a clearance space is created, thus allowing the upper pin 55 to drop down and ultimately this in turn allows the die center 44 to drop away. Upper pin 55 and the cooperating linkage leading to die center 44 function as a blocking portion while pin 56 functions as the release portion. The clearance space is created below pin 55 by the movement of pin 56.

Diagrammatic illustrations of the connection and interaction between the slide block 53, cam rail 54 and pin 56 are provided by FIGS. 6, 6A, 7, and 7A. The attachment or connection of the cam rail to the ends of pin 56 is diagrammatically illustrated as a top plan view in FIG. 7A. As is illustrated, the center pin 56 of each three pin stack is longer than the other two pins 55 and 57. By providing pin 56 with additional length and by centering these three pins, the free ends of pins 55 and 57 are effectively even or flush with one another at each end. As for pin 56 which is longer, at one end a portion of pin 56 extends beyond the flush ends of pins 55 and 57 and the same occurs as the other opposite end of pins 55 and 56. These extended end portions are then used to attach to the cam rail 54. In fact there are side-by-side or parallel cam rails so that each end of pin 56 can be acted upon by the corresponding cam rail 54. Additional details of the slide block 53 and cam rail 54 release and movement are set forth hereinafter.

Figure 4:
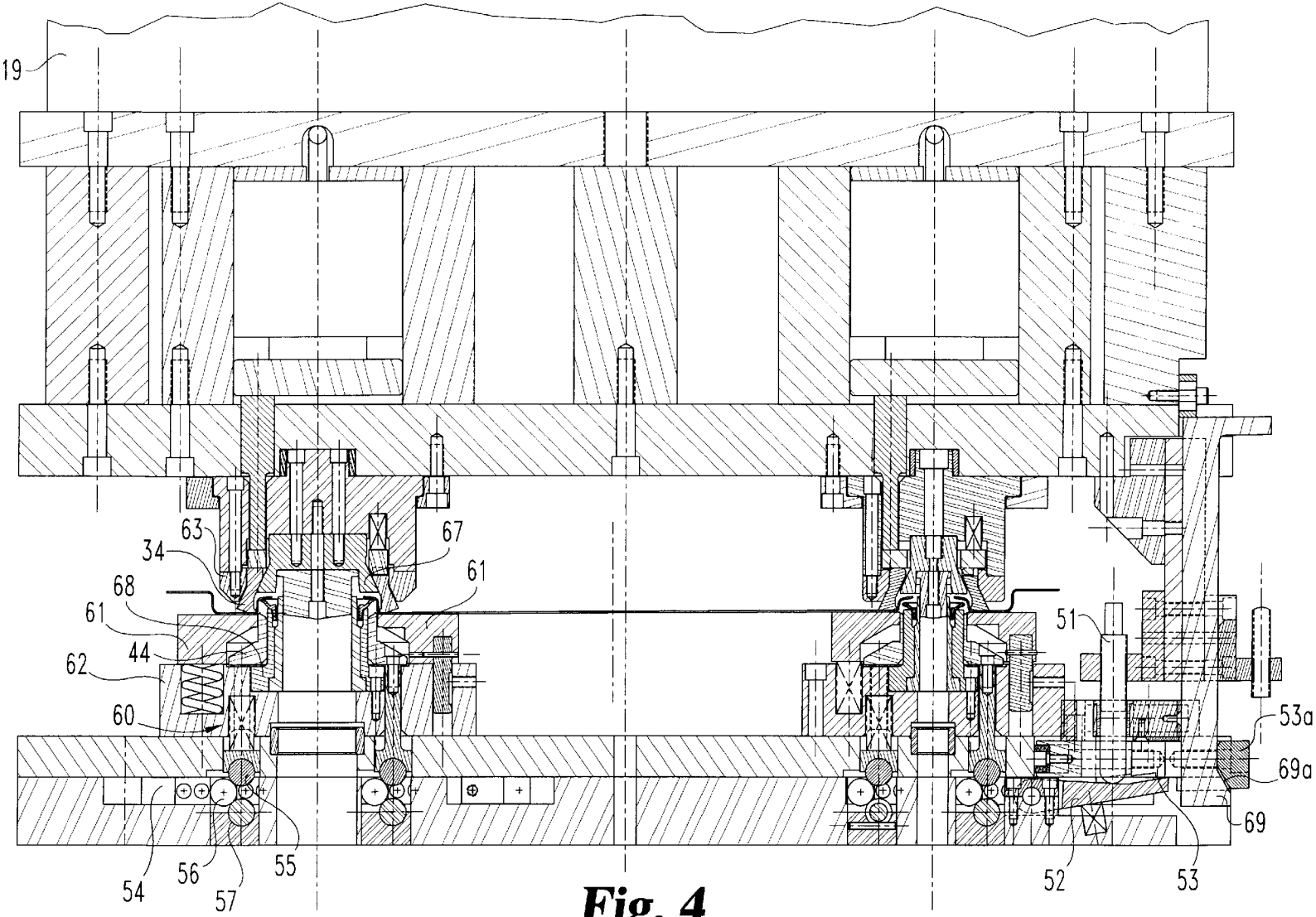
FIG. 4 is a diagrammatic front elevational view in full section of the FIG. 1 insertion die at a still later time in the press stroke cycle.
Figure 4A:
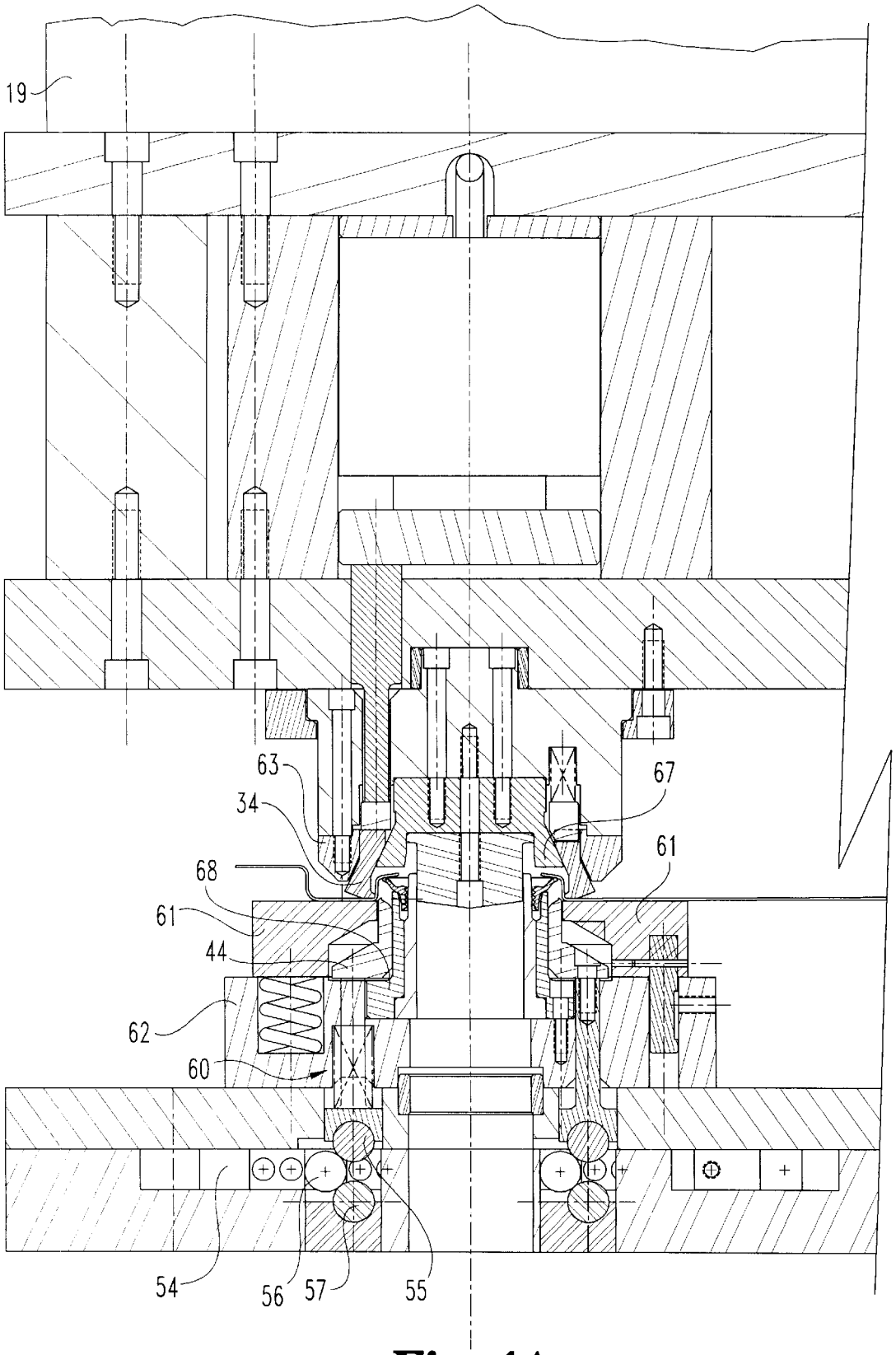
FIG. 4A is an enlarged detail of one workstation of the FIG. 4 insertion die.

As the cam rails 54 move horizontally to the left, see FIGS. 4 and 4A, they push on the ends of pins 56 causing pins 56 to shift to the left and drop down slightly. This creates a clearance space between pins 55 and 57 at each of the four locations, enabling each pin 55 to drop. This in turn creates a clearance space for the die center 44 to drop down. When the die center 44 drops down below the crimping jaws 34, the jaws are no longer blocked.

When the slide block 53 is effectively locked in its "initial" position, the cam rails 54, which extend continuously from one side of workstation 28 to the opposite side of workstation 27, are unable to shift or move horizontally. This keeps pins 55, 56, and 57 arranged in their near vertical stack at all four locations, locations 58*a* and 58*b* for workstation 27 and locations 59*a* and, 59*b* for workstation 28. Not only are the three pins 55, 56, and 57 in contact with each other, but the remaining portions of the insertion die mechanism above pin 55 and between pin 55 and the crimping jaws 34 are also in contact and this is why the die center 44 is unable to drop down or move out of the way until some type of clearance is provided in the area of the three pins.

The horizontal movement of cam rails 54 effectively shifts the middle pin 56 of each three pin stack at each of the four locations simultaneously. As the description continues to focus on the three pins at locations 58*a*, it is to be understood that virtually identical pin movement occurs at locations 58*b*, 59*a*, and 59*b*.

When pin 56 shifts out of the three pin stack by moving horizontally and downwardly, a clearance space is in effect created below the upper pin 55 which is then allowed to drop downwardly, and this in turn allows the mechanical combination 60 located between pin 55 and die center 44 to drop down which then lets the die center 44 drop down. Once this occurs, the upper "blocking" top 48 of die center 44 is no longer positioned radially between the embossment and the flange adjacent the crimping jaws 34, see FIGS. 4 and 4A, as the system transitions from the FIG. 2 stage.

As this sequence of events is occurring, the stripper pad 61 bottoms out against the auxiliary die holder 62. This overcomes the spring force of nitrogen spring 38 on the upper riser block 36, allowing the jaws 34 to collapse radially inwardly, being pushed inwardly by closing ring 63, see FIGS. 4, 4A, 5, and 5A.

The key to the present invention is to be able to get the die center 44 out of the way before the crimping jaws 34 close on it. With the stacked pin arrangement of pins 55, 56, and 57 changing alignment, the die center 44 is allowed to fall away very rapidly before the crimping jaws 34 close in on it. If the die center was pushed out of the way at the same rate as the downward movement of the ram portion of the press, the jaws 34 would crimp onto the die center before it was out of the way.

Figure 5:
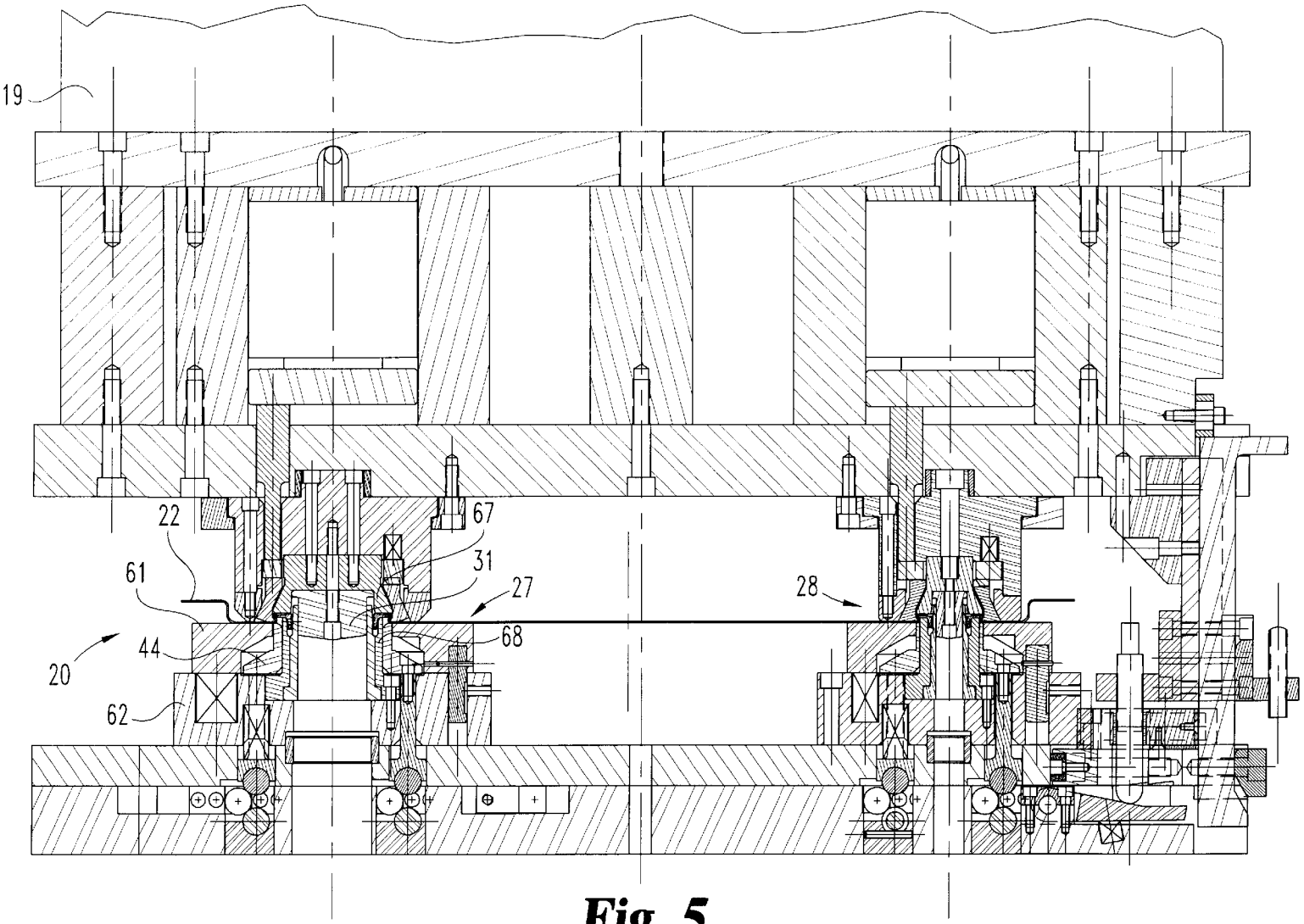
FIG. 5 is a diagrammatic, front elevational view in full section of the FIG. 1 insertion die at a still later time in the press stroke cycle.
Figure 5A:
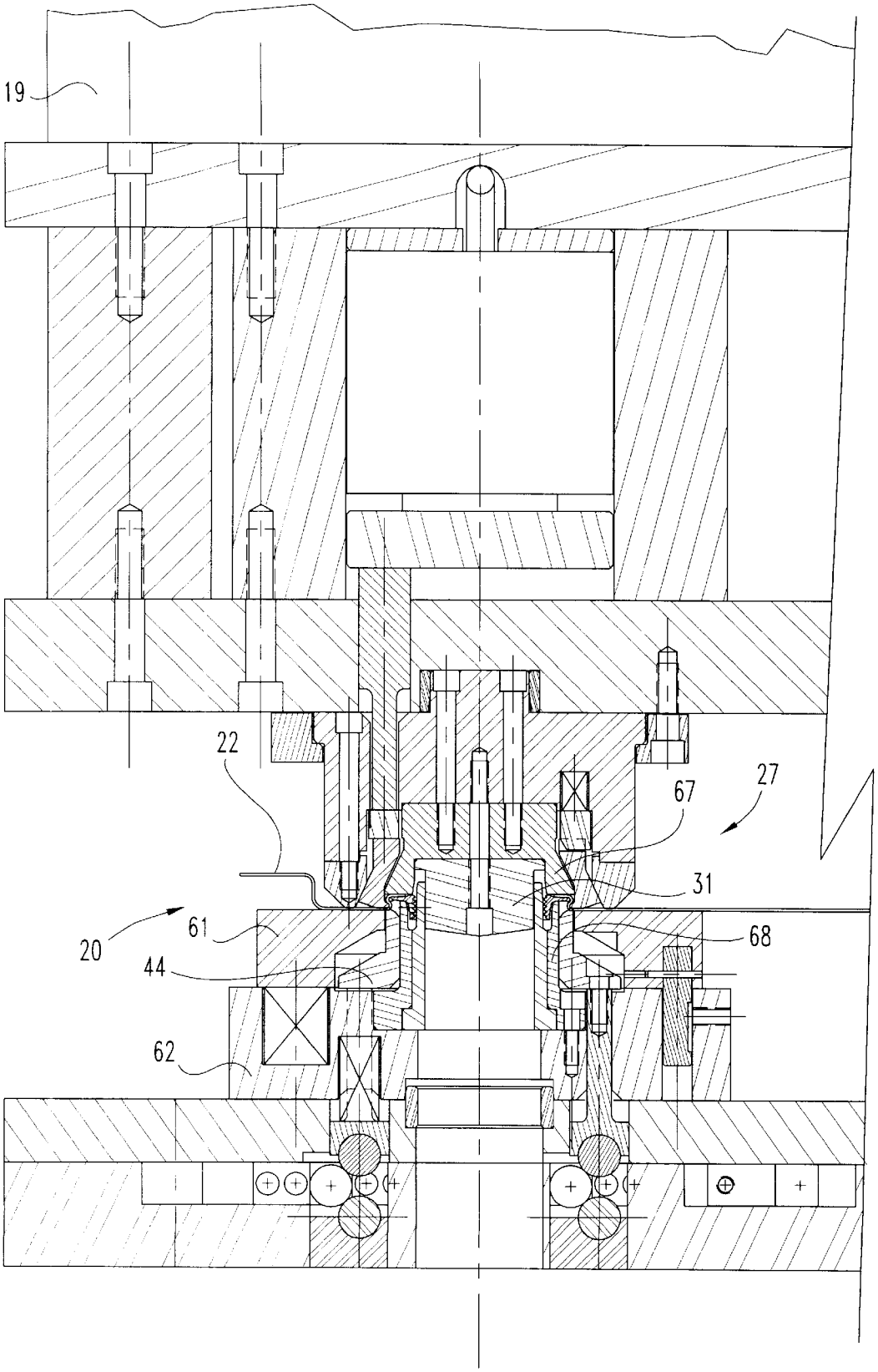
FIG. 5A is an enlarged detail of one workstation of the FIG. 5 insertion die.

As the ram portion continues in a downward direction, the punch center 67 and anvil 68 flatten the drum head stock against the top of flange 23 while the jaws complete their crimping operation, see FIGS. 5 and 5A. When the ram portion returns upward to complete the one stroke cycle, the slide cam 69 is drawn upwardly and this in turn shifts the slide block 53 and cam rails 54 back in the horizontal direction to the right and re-engages the sear 52. Slide cam 69 extends through an opening in slide block 53 with portion 53*a* denoting one part of slide block 53. The angled ramp portion 69*a* of slide cam 69 is used to push portion 53*a* to the right in order to pull the cam rails 54*a* and 54*b* back to the right. This causes the sear 52 to reengage with slide block 53. This in turn prepares the die center for the next flange/drum head assembly. As will be understood, the horizontal movement (i.e., return) of the cam rails 54 pushes each pin 56 back into its near vertical stack with pins 55 and 57 at each of the four locations, two for each workstation as previously described and as illustrated.

Additional disclosure of the cam rail mechanism is provided by the diagrammatic illustrations of FIGS. 6, 6A, 7, and 7A. As has been described, in its initial or starting position the sear 52 is located in recess 75 of slide block 53. As sear pin 51 is pushed in a downward vertical or axial direction as part of the press stroke cycle, it contacts sear 52 and pushes it free of recess 75. It will be noted that sear 52 is mounted on a pivot 76 and is spring biased by means of compression spring 77. As the sear pin 51 contacts the upper surface of sear 52, sear 52 pivots in a clockwise direction, causing the tip of sear 52 to be pushed out of recess 75 as spring 77 is compressed.

Slide block 53 can be considered or thought of as a generally T-shaped member (see FIG. 7A) with a base 78 that includes recess 75. The cross bar portion 79 is symmetrically positioned and securely attached to the top surface of each of the two substantially parallel cam rails 54*a* and 54*b*. The end 80 of base 78 is spring biased in a horizontal direction by means of compression spring 81 which is positioned between end 80 and abutment 82.

When the sear 52 is pushed out of recess 75, and as spring 77 is compressed and spring 81 extends, this action causes the slide block 53 to be pushed by means of spring 81 to the left (based on the FIG. 4 orientation) a relatively short distance. This movement causes the two cam rails 54*a* and 54*b* to also move a short distance to the left (see FIG. 4) and this results in the center pins 56 of each of the four stacked pin arrangements to shift out of the stacked order which in turn creates a clearance space and allows the top pin to drop down. The top and bottom pins of each stacked arrangement are held in place by a ring and a small circumferential surface groove is provided around each pin 55 and 57 which receives the securing ring. This arrangement prevents pins 55 and 57 from shifting horizontally.

Each cam rail 54*a* and 54*b* is configured with a relief slot 83 for capturing one end of each pin 56 of each three pin stacked arrangement at locations 58*a*, 58*b*, 59*a*, and 59*b*. By positioning the ends of each pin 56 in a corresponding slot 83 of each cam rail 54*a* and 54*b*, the pins 56 move in a synchronous fashion as the two cam rails are pushed to the left by the movement of slide block 53. A single sear pin 51, a single sear 52, and a single slide block 53 are used in this cam rail mechanism while there are two cam rails 54*a* and 54*b* utilized for moving the four center pins.

Figure 6:
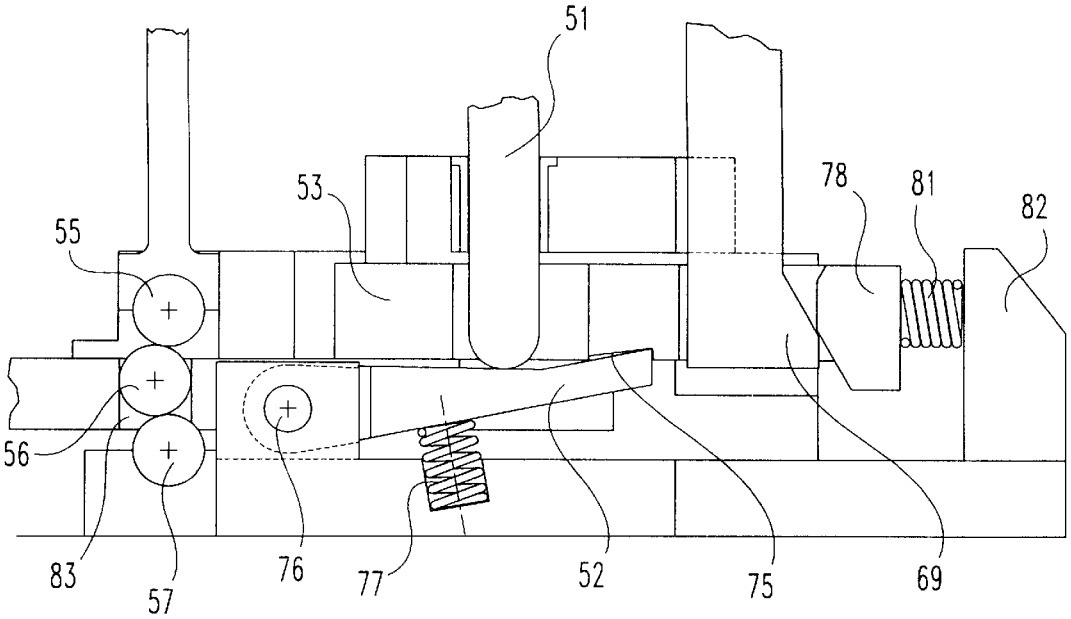
FIG. 6 is a diagrammatic illustration of a cam rail mechanism which comprises one portion of the FIG. 1 insertion die.
Figure 6A:
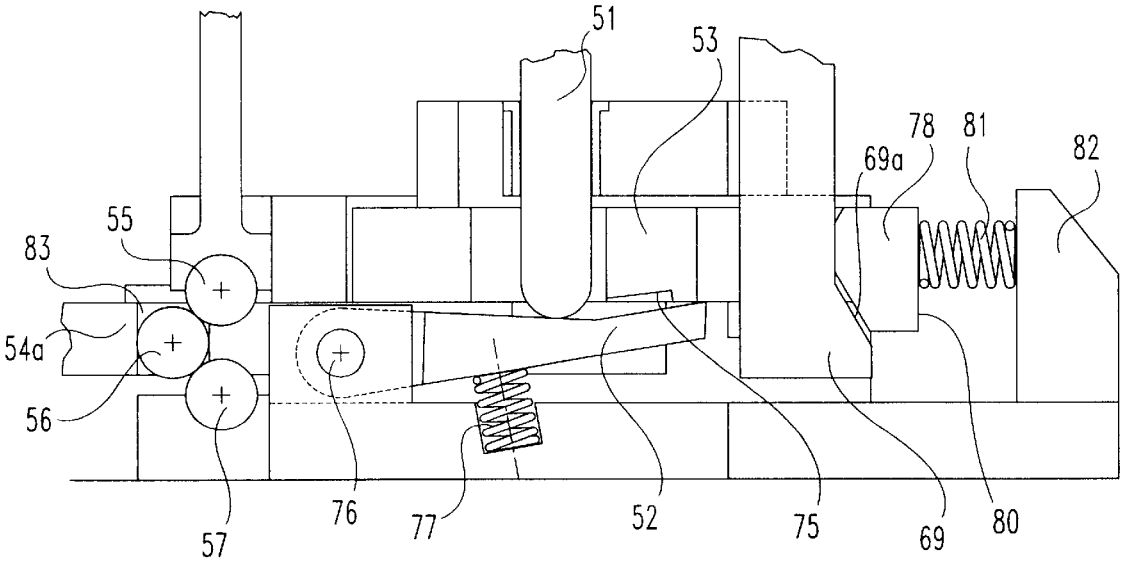
FIG. 6A is a diagrammatic illustration of the FIG. 6 cam rail mechanism at a later time in the press stroke cycle.
Figure 7:
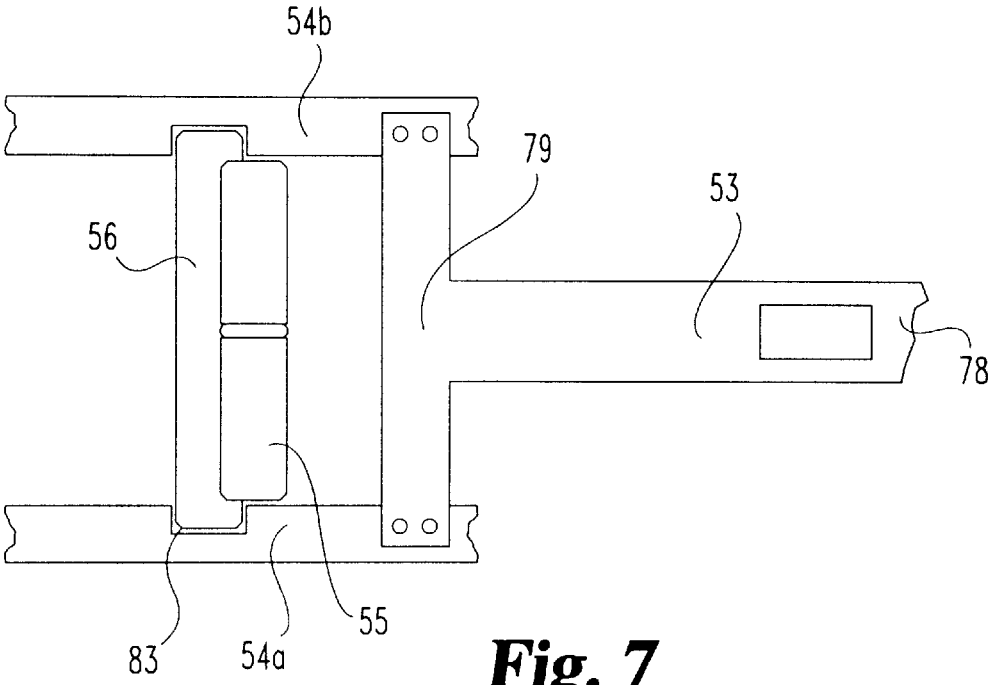
FIG. 7 is a diagrammatic illustration of the FIG. 6 cam rail mechanism in combination with a center pin comprising a portion of a release mechanism according to the present invention.
Figure 7A:
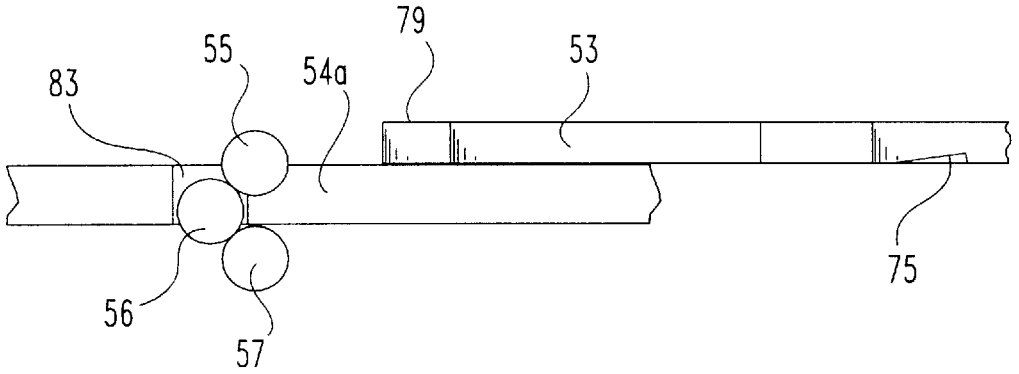
FIG. 7A is a diagrammatic illustration of the FIG. 6 cam rail mechanism in combination with a center pin comprising a portion of a release mechanism according to the present invention.

The orientation of FIG. 6 generally corresponds to a press and die condition or position when the hole is pierced and the embossment 45 is created. The orientation of FIGS. 6A and 7 corresponds generally to when the crimping jaws begin closing in in order to crimp the flange 23 in position within embossment 45. Actual crimping is only permitted once the die center 44 is able to drop down and out of the way and this requires that the center pins 56 be shifted out of their stacked arrangement with pins 55 and 57.

When the slide cam 69 moves in an upward direction as part of the return stroke for the press cycle, its ramp surface 69*a* actually pulls the slide block 53 to the right. As this movement is occurring, the sear pin 51 is also raised by the press mechanism and the spring-biased nature of sear 52 causes its tip portion to re-engage within recess 75 in slide block 53. This results in spring 77 extending and spring 81 compressing. This thus resets the mechanism for the next press stroke cycle. The pulling back of the slide block 53 to the right causes the cam rails 54*a* and 54*b* to also pull back to the right thereby draw the shifted pins 56 back into their stacked alignment between pins 55 and 57 at each of the four locations. Just as pins 56 were shifted in a synchronous manner to the left, they are also brought back into alignment in a synchronous manner as slide block 53 and cam rails 54*a* and 54*b* move to the right.

The conversion of a previous two-step, two-stroke process into a single-step, single-stroke process results in significant economies and efficiencies.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An insertion die for the installation of an internally-threaded flange into a drum head workpiece by means of a single stroke of a cooperating press, said insertion die comprising:

a pierce punch and cooperating piercing hole die for creating a hole in said drum head workpiece, an anvil for receipt of said internally-threaded flange, crimping jaws constructed and arranged for crimping the drum head workpiece onto said internally-threaded flange, a moveable die center positioned in part between said internally-threaded flange and said drum head workpiece and being constructed and arranged to prevent the crimping of the drum head workpiece onto the internally-threaded flange when in a first position, and release means, including an upper blocking portion and a release portion, said release means being operably coupled to said moveable die center for creating a clearance space between said upper blocking portion and said release portion, the creation of said clearance space enabling said moveable die center to move to a second position where said moveable die center is no longer between said internally-threaded flange and said drum head workpiece, thereby permitting said crimping jaws to crimp said drum head workpiece onto said internally-threaded flange during said single stroke.

2. The insertion die of claim 1 which includes two spaced-apart workstations, said internally-threaded flange being located at a first one of said workstations and a supplemental flange being located at a second one of said workstations.

3. The insertion die of claim 2 wherein said release means includes a slide block, a cooperating and moveable cam rail, and a plurality of stacked pins, one pin of said plurality of stacked pins being attached to said cam rail such that when said slide block is moved out of engagement with said cam rail, the cam rail is allowed to move, thereby moving said one pin for creating said clearance space.

4. The insertion die of claim 3 wherein said plurality of stacked pins includes three pins and said cam rail is connected to the middle pin.

5. The insertion die of claim 4 which further includes a pressure unit with a cooperating pneumatic cylinder.

6. The insertion die of claim 5 wherein said pneumatic cylinder is constructed and arranged as a charged nitrogen spring.

7. The insertion die of claim 1 wherein said release means includes a slide block, a cooperating and moveable cam rail, and a plurality of stacked pins, one pin of said plurality of stacked pins being attached to said cam rail such that when said slide block is moved out of engagement with said cam rail, the cam rail is allowed to move, thereby moving said one pin for creating said clearance space.

8. The insertion die of claim 7 wherein said plurality of stacked pins includes three pins and said cam rail is connected to the middle pin.

9. The insertion die of claim 1 which further includes a pressure unit with a cooperating pneumatic cylinder.

10. The insertion die of claim 9 wherein said pneumatic cylinder is constructed and arranged as a charged nitrogen spring.

11. An insertion die for preparing a drum head workpiece and the installation of an internally-threaded flange into said drum head workpiece, the preparing and installation being performed during the same single press stroke of a cooperating press, said insertion die comprising:

a plurality of crimping jaws for crimping said drum head workpiece onto said internally-threaded flange, a die center constructed and arranged to be moveable between a first blocking position and a second release position, in said first blocking position said die center being positioned between said drum head workpiece and said internally-threaded flange adjacent said plurality of crimping jaws, and in said second release position said die center being positioned axially below said plurality of crimping jaws and release means, including an upper blocking portion and a release portion, said release means being operably coupled to said die center and being constructed and arranged for creating a clearance space between said upper blocking portion and said release portion, the creation of said clearance space enabling said die center to move to said second release position.

12. The insertion die of claim 11 which includes two spaced-apart workstations, said internally-threaded flange being located at a first one of said workstations and a supplemental flange being located at a second one of said workstations.

13. The insertion die of claim 12 wherein said release means includes a slide block, a cooperating and moveable cam rail, and a plurality of stacked pins, one pin of said plurality of stacked pins being attached to said cam rail such that when said slide block is moved out of engagement with said cam rail, the cam rail is allowed to move, thereby moving said one pin for creating said clearance space.

14. The insertion die of claim 13 wherein said plurality of stacked pins includes three pins and said cam rail is connected to the middle pin.

15. The insertion die of claim 14 which further includes a pressure unit with a cooperating pneumatic cylinder.

16. The insertion die of claim 15 wherein said pneumatic cylinder is constructed and arranged as a charged nitrogen spring.

17. The insertion die of claim 11 wherein said release means includes a slide block, a cooperating and moveable cam rail, and a plurality of stacked pins, one pin of said plurality of stacked pins being attached to said cam rail such that when said slide block is moved out of engagement with said cam rail, the cam rail is allowed to move, thereby moving said one pin for creating said clearance space.

18. The insertion die of claim 17 wherein said plurality of stacked pins includes three pins and said cam rail is connected to the middle pin.

19. The insertion die of claim 11 which further includes a pressure unit with a cooperating pneumatic cylinder.

20. The insertion die of claim 19 wherein said pneumatic cylinder is constructed and arranged as a charged nitrogen spring.

21. A method of installing an internally-threaded flange into a drum head of a container by means of a press and insertion die combination, said method comprising the following steps:

providing a press with a moveable portion and a stroke cycle moving from a start position to a crimping position and back to the start position during each stroke; and providing an insertion die with a pierce punch, piercing hole die, anvil, a plurality of crimping jaws, a die center and release means, including an upper blocking portion and a release portion;

loading a drum head and an internally-threaded flange into said insertion die;

positioning said die center between said drum head and said flange radially adjacent said plurality of crimping jaws;

initiating the stroke cycle of said press;

piercing a hole in said drum head;

activating said release means by continuing said stroke cycle to create a clearance space between said upper blocking portion and said release portion for movement of said die center;

moving said die center to a position below said plurality of crimping jaws; and crimping said drum head onto said internally-threaded flange.

* * * * *